US008169163B2

(12) United States Patent
Kang et al.

(10) Patent No.: US 8,169,163 B2
(45) Date of Patent: May 1, 2012

(54) CONTROL DEVICE AND LED LIGHT EMITTING DEVICE USING THE CONTROL DEVICE

(75) Inventors: Eunchul Kang, Seoul (KR); Duckki Kwon, Incheon (KR); Juho Kim, Seoul (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 440 days.

(21) Appl. No.: 12/612,819

(22) Filed: Nov. 5, 2009

(65) Prior Publication Data

US 2010/0110059 A1 May 6, 2010

(30) Foreign Application Priority Data

Nov. 6, 2008 (KR) ..... 10-2008-0110028

(51) Int. Cl.
*H05B 37/00* (2006.01)

(52) U.S. Cl. ..... 315/312; 315/294; 315/291; 315/320; 315/307; 315/224; 315/185 R

(58) Field of Classification Search ..... 315/185 R, 315/224, 225, 247, 291, 294, 297, 307, 308, 315/312, 318, 320; 345/82, 102, 204, 211–213
See application file for complete search history.

(56) References Cited

U.S. PATENT DOCUMENTS

| | | | | |
|---|---|---|---|---|
| 7,605,809 | B2 * | 10/2009 | Wey et al. | 345/212 |
| 7,923,943 | B2 * | 4/2011 | Peker et al. | 315/312 |
| 2007/0069712 | A1 | 3/2007 | Kamatani | |
| 2007/0159421 | A1 | 7/2007 | Peker et al. | |
| 2007/0171271 | A1 | 7/2007 | Wey et al. | |
| 2009/0295776 | A1 * | 12/2009 | Yu et al. | 345/212 |
| 2010/0327772 | A1 * | 12/2010 | Lee et al. | 315/297 |
| 2011/0199010 | A1 * | 8/2011 | Cho et al. | 315/186 |

* cited by examiner

*Primary Examiner* — Haiss Philogene
(74) *Attorney, Agent, or Firm* — Okamoto & Benedicto LLP

(57) ABSTRACT

The present invention relates to a control device of a light emitting device that includes a plurality of LED rows formed of a plurality of LEDs sequentially connected in series. The control device includes: a plurality of switches respectively connected to the plurality of LED rows and sequentially transmitting a detection voltage of each of the plurality of LED rows, wherein the detection voltage corresponds to an output voltage applied to the plurality of LED rows; a comparator receiving the plurality of detection voltages, and generating a clock control signal according to a result of comparison with a predetermined reference; a clock signal generator generating a clock signal having a period that is changed according to the clock control signal; and a shift register that controls switching operations of the plurality of switches according to the clock signal.

20 Claims, 2 Drawing Sheets

CONTROL DEVICE AND LED LIGHT EMITTING DEVICE USING THE CONTROL DEVICE

CROSS-REFERENCE TO RELATED APPLICATION

This application claims priority to and the benefit of Korean Patent Application No. 10-2008-0110028 filed in the Korean Intellectual Property Office on Nov. 6, 2008, the entire contents of which are incorporated herein by reference.

BACKGROUND OF THE INVENTION (a) Field of the Invention

The present invention relates to a control device of a light emitting device formed of light emitting diodes (LEDs). Particularly, it relates to a control device that drives a light emitting device including a plurality of LED rows formed of a plurality of LEDs connected in series.

(b) Description of the Related Art

A light emitting device may display an image, or may be used as a light source of a display device such as a liquid crystal display (LCD). Particularly, a light emitting device formed of a plurality of LEDs is widely used as a back light of an LED display device. The LED light emitting device includes a plurality of LED rows formed by a plurality of LEDs arranged in series and a converter that supplies an output voltage to each of the plurality of LED rows. The output voltage is supplied to at one end of each of the plurality of LED rows, and a constant current source that regulates a current flowing to each of the plurality of LED rows is connected to the other end thereof. When a current flows to the LED and light is emitted, a voltage drop is generated along a direction of a current at lateral ends of the LED. In addition, voltage drops of all LEDs are not constant due to characteristics thereof. Therefore, the converter supplies a sufficient voltage to each of the plurality of LED rows so that each LED of the LED rows can emit light regardless of the voltage drop. A constant current source includes a synch current source, and the synch current source is connected to each of the plurality of LEDs to maintain a constant current. When a voltage is applied to the synch current source, power is consumed, and therefore it is preferred to apply the lowest voltage to the synch current source.

However, a voltage that is higher than a predetermined reference voltage is required for driving the synch current source, and therefore the voltage applied to the synch current source cannot be decreased without limit.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a control device having an advantage of controlling an output voltage of a converter, and an LED light emitting device including the same.

A control device according to an exemplary embodiment of the present invention includes a plurality of LED rows formed of a plurality of LEDs that are sequentially connected in series. The control device includes: a plurality of switches respectively connected to the plurality of LED rows and sequentially transmitting a detection voltage of each of the plurality of LED rows, wherein the detection voltage corresponds to an output voltage applied to the plurality of LED rows; a comparator receiving the plurality of detection voltages, and generating a clock control signal according to a result of comparison with a predetermined reference; a clock signal generator generating a clock signal having a period that is changed according to the clock control signal; and a shift register that controls switching operations of the plurality of switches according to the clock signal. The control device further includes a plurality of synch current sources at an end of each of the plurality of LED rows and each of the plurality of detection voltages are respectively supplied to the plurality of synch current sources, and the reference voltage is a minimum voltage for driving the synch current source. The clock signal generator determines a period of the clock signal according to a time that a detection voltage that is lower than the reference voltage among the plurality of detection voltages reaches the reference voltage when the detection voltage is detected through the clock control signal. The clock signal generator includes an oscillator generating an internal clock signal having a predetermined period and a first logical operator that receives the internal clock signal and a signal corresponding to the clock control signal, and the first logical operator generates a clock signal when the clock control signal is at a first level and generates a third level clock signal when the clock control signal is at a second level. The clock signal generator further includes a second logical operator that receives the clock control signal and a reset signal that becomes a pulse signal for a predetermined time period when the control device is driven and is maintained at a constant level during a normal state, and the second logical operator determines a level of an output signal according to the clock control signal and transmits the output signal of the determined level to the first logical operator for the normal state. The comparator receives the detection voltage through an inversion terminal and the reference voltage through a non-inversion terminal, and the first logical operator is a NOR gate, the second logical operator is an AND gate, the first level is a high level, and the second and third levels are low levels. In addition, the shift register includes a counter that generates a start signal by counting the clock signal a number of times that corresponds to the number of the plurality of LED rows, and sequentially outputs the start signal to a plurality of switches for each period of the clock signal from a time that is delayed for one period of the clock signal from a first time that the start signal is generated. The shift register includes a plurality of flip-flops that respectively correspond to the number of the plurality of LED rows, and the n-th flip-flop among the plurality of flip-flops outputs an output signal of the (n−1) th flip-flop that is input for the n-th period of the clock signal with reference to the first time to the (n+1)th flip-flop for the (n+1)th period of the clock signal. Switching operations of each of the plurality of switches are controlled by an output signal output from each of the plurality of flip-flops. The control device further includes a feedback signal generator that generates a feedback signal that corresponds to the output voltage according to the clock control signal, and the feedback signal generator includes: a capacitor; charging and discharging switches that perform switching operations according to the clock control signal; a charging current source that supplies a charging current to the capacitor when the charging switch is turned on; a discharging current source that discharges the capacitor when the discharging switch is turned on; and a feedback switch that performs switching operations according to voltages at lateral ends of the capacitor. The charging and discharging switches are alternately turned on/off.

An LED light emitting device that includes a plurality of LED rows formed of a plurality of LEDs that are sequentially connected in series according to another exemplary embodiment of the present invention includes: a converter including a power switch and an inductor, and generating an output voltage applied to the plurality of LED rows by controlling a current flowing to the inductor according to switching operations of the power switch; a PWM controller that controls the switching operation of the power switch; and a control device that generates a clock signal that corresponds to the output voltage applied to the plurality of LED rows and having a varying period according to a result of comparison between a detection voltage of each of the plurality of LED rows and a predetermined reference voltage, sequentially measures the plurality of detection voltages according to the clock signal, and generates a feedback signal corresponding to the output voltage according to the comparison result and transmitting the feedback signal to the PWM controller. The control device includes: a plurality of switches respectively connected to the plurality of LED rows, and sequentially transmitting a plurality of detection voltages that correspond to output voltages applied to the plurality of LED rows; a comparator receiving the plurality of detection voltages, and generating a clock control signal according to a result of comparison between the detection voltage and the reference voltage; a clock signal generator that generates a clock signal having a varying period according to the clock control signal; and a shift register that controls switching operations of the plurality of switches according to the clock signal. The control device further includes a plurality of synch current sources respectively provided at each end of the plurality of LED rows, each of the plurality of detection voltages is a voltage supplied to the plurality of synch current sources, and the reference voltage is a minimum voltage for driving the synch current source. When a detection voltage that is lower than the reference voltage among the plurality of detection voltages is detected through the clock control signal, the clock signal generator determines a period of the clock signal according to a time that the low detection voltage reaches the reference voltage. The clock signal generator includes an oscillator that generates an internal clock signal having a predetermined period and a first logical operator that receives the internal clock signal and a signal that corresponds to the clock control signal, and the first logical operator generates a clock signal according to the internal clock signal when the clock control signal is a first level, and generates a third-level clock signal when the clock control signal is a second level. The clock signal generator further includes a second logical operator that receives the clock control signal and a reset signal that becomes a pulse signal for a predetermined period when the control device is driven and is maintained at a constant level at a normal state, and during the normal state, the second logical operator determines a level of an output signal according to the clock control signal and transmits the output signal to the first logical operator. In addition, the shift register includes a counter that generates a start signal by counting the clock signal a number of times that corresponds to the plurality of LED rows, and sequentially outputs the start signal to each of a plurality of switches for each period of the clock signal from a time that is delayed for one period of the clock signal from a first time that the start signal is generated. The control device further includes: a capacitor, charging and discharging switches that perform switching operations according to the clock control signal; a charging current source that supplies a charging current to the capacitor when the charging switch is turned on; a discharging current source that discharges the capacitor when the discharging switch is turned on; and a feedback switch that performs switching operations according to voltages at lateral ends of the capacitor, wherein the charging and discharging switches are alternately turned on/off. The PWM controller controls the duty of the power switch according to the feedback signal.

According to the present invention, a control device that can control an output voltage of a converter, and an LED light emitting device including the control device, are provided.

DETAILED DESCRIPTION OF THE EMBODIMENTS

Figure 1:
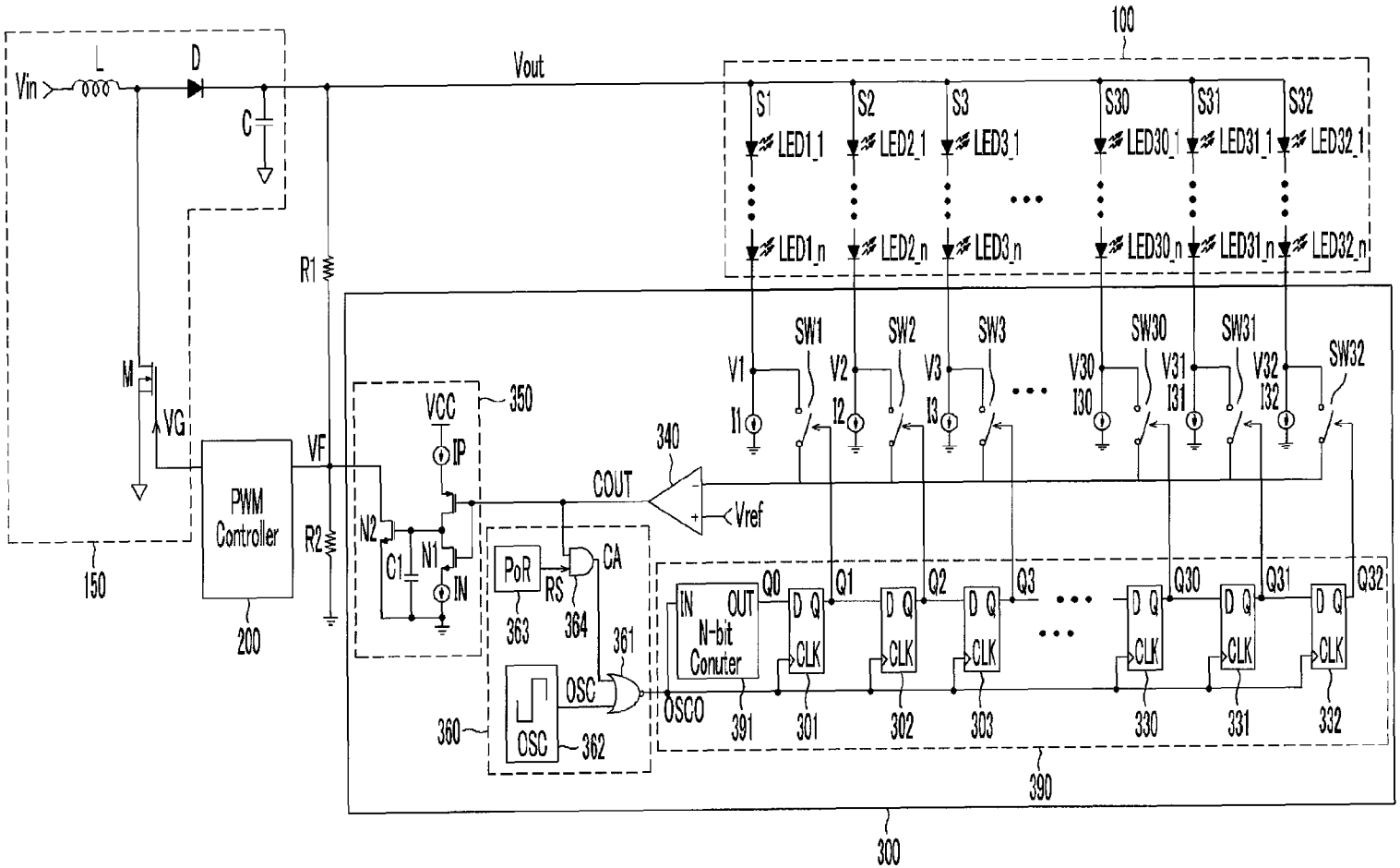
FIG. 1 shows an LED light emitting device with application of a control device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows an LED light emitting device with application of an exemplary embodiment of the present invention.

As shown in FIG. 1, the LED light emitting device includes a converter 150 that supplies an output voltage, an LED light emission unit 100, a control device 300, and a pulse width modulation (PWM) controller 200. An output end of the controller 200 is connected to a node to which a first end of a resistor R1 and a first end of a resistor R2 are connected, a second end of the resistor R1 is connected to an output end of the converter 150 so that an output voltage is applied thereto, and a second end of the resistor R2 is grounded.

The LED light emission unit 100 includes a plurality of LED rows S1 to S32, and each of the plurality of LED rows includes n LEDs. Particularly, the LED row S1 includes n LEDs LED1_1 to LED1_n. In a like manner, each of the plurality of LED rows S2 to S32 includes n LEDs LED2_1 to LED2_n, LED3_1 to LED3_n, . . . , LED30_1 to LED30_n, LED31_1 to LED31_n, and LED32_1 to LED32_n. In the exemplary embodiment of the present invention, the number of the plurality of LED rows S1 to S32 is set to 32, but it is not limited thereto. This is merely an example.

The converter 150 includes an inductor L, a capacitor C, a diode D, and a switch M. The switch M according to the exemplary embodiment of the present invention is formed of an n-channel metal oxide semiconductor field effect transistor (NMOSFET). However, the present invention is not limited thereto, and it is well known to a person of ordinary skill in the art that the switch M may be realized as a p-channel metal oxide semiconductor field effect transistor (PMOSFET) or a bipolar junction transistor (BJT). An input voltage Vin is supplied to a first end of the inductor L1, and a second end of the inductor L1 is connected to an anode of the diode D. A drain electrode of the switch M is connected to the anode of the diode D and the second end of the inductor L. In the inductor L1, an inductor current IL corresponding to the input voltage Vin flows. The switch M controls the current flowing through the inductor L1. When the switch M is turned off, the capacitor C is charged by the current flowing through the inductor L and generates an output voltage. When the switch M is turned on, the diode D is disconnected and the inductor current IL flows through the switch M. When the switch M is turned off, the diode D is connected and the inductor current IL flows through the diode D. A voltage charged in the capacitor C becomes an output voltage Vout. In order to increase the output voltage Vout, the amount of inductor current IL transmitted to the capacitor C through the diode D should be increased and accordingly the turn-on time (i.e., duty) of the switch M should be increased. In order to decrease the output voltage, the inductor current IL should flow to the switch M, and therefore the turn-on time of the switch M, that is, the duty of the switch M, should be reduced. The switch M according to the exemplary embodiment of the present invention is switched according to a gate signal VG transmitted from the PWM controller 200, and the PWM controller 200 determines the duty of the switch M according to a feedback signal VF transmitted from the control device 300.

The control device 300 detects a voltage applied to a current source connected to an end of the plurality of LED rows, and controls the PWM controller 200 to increase or decrease the output voltage. The control device 300 includes a plurality of synch current sources I1 to I32, a comparator 340, a shift register 390, a clock signal generator 360, and a feedback signal generator 350. The plurality of synch current sources I1 to I32 are connected to each end of the plurality of LED rows S1 to S32 and synchronize a predetermined current. A first end of each of a plurality of switches SW1 to SW32 is connected to a node to which each of the plurality of LED rows S1 to S32 and each of the plurality of synch current sources I1 to I32 are connected, and a second end is connected to an inversion terminal (−) of the comparator 340. Each of the plurality of switches SW1 to SW32 is switched according to detection control signals Q1 to Q32 output from the shift register 390. In the exemplary embodiment of the present invention, the plurality of switches SW1 to SW32 are turned on when the detection control signals Q1 to Q32 are high level signals, and are turned off when the detection control signals Q1 to Q32 are low level signals.

The comparator 340 compares a voltage input to the inversion terminal (−) and a reference voltage Vref, and generates a clock control signal COUT according to the comparison result. When the voltage input to the inversion terminal (−) is lower than the reference voltage Vref, the comparator 340 outputs a high-level clock control signal COUT, and when the voltage input to the inversion terminal (−) is higher than the reference voltage Vref, the comparator 340 outputs a low-level clock control signal COUT. The voltage output to the inversion terminal (−) of the comparator 340 is a voltage at each end of the respective LED rows S1 to S32, which is detection voltages V1 to V32 applied to the synch current sources I1 to I32. When the plurality of switches SW1 to SW32 are sequentially turned on, a detection voltage of the plurality of detection voltages V1 to V32 corresponding to a turn-on switch of the plurality of switches SW1 to SW32 is input to the inversion terminal (−) of the comparator 340. In this case, the reference voltage Vref can be set to a minimum voltage for operation of the synch current sources I1 to I32.

The clock signal generator 360 controls a measuring period for the detection voltages V1 to V32 according to the output signal of the comparator 340. The clock signal generator 360 determines whether any of the detection voltages V1 to V32 are lower than the reference voltage Vref through the clock control signal COUT. If a voltage that is lower than the reference voltage Vref exists in the detection voltage V1 to V32, the clock signal generator 360 controls the shift register 390 to compare the corresponding detection voltage and the reference voltage Vref until the corresponding detection voltage reaches the reference voltage Vref. In further detail, while measuring a detection voltage that is lower than the reference voltage Vref, generation of the next clock signal is delayed by increasing the present clock signal (OSCO) period. The shift register 390 sequentially outputs a plurality of detection control signals Q1 to Q32 for every period of the clock signal OSCO.

A detailed configuration of each of the clock signal generator 360 and the shift register 390 will be described first, and operation thereof will then be described.

The clock signal generator 360 includes an AND gate 364, a power on reset (PoR) 363, a NOR gate 361, and an oscillator 362. The AND gate 364 generates and outputs a signal CA according to a result of an AND operation between an output signal of the PoR 363 and an output signal of the comparator 340. When the control device 300 is supplied with power and then starts to operate, the PoR 363 generates a reset signal and transmits the reset signal to the AND gate 364. The reset signal is a signal that resets the output signal of the AND gate 364, and includes a low-level pulse signal. When the LED light emission device is not supplied with sufficient output voltage Vout from the converter 150 at an initial operation stage, the detection voltage V1 to V32 is lower than the reference voltage Vref so that the clock control signal COUT that includes a period of the clock signal OSC is maintained so that the next clock signal OSCO may not be generated. In order to prevent this, a reset signal that is the same as a low-level pulse is output to generates a clock signal OSCD with a predetermined period when the control device 300 is driven. The oscillator 362 generates an internal clock signal having a predetermined period. The NOR gate 361 generates a clock signal OSCO by using the signal CA and the internal clock signal. When the signal CA is a low level signal, that is, a detection voltage that is higher than the reference voltage Vref among the detection voltages V1 to V32 is input to the comparator 340, that NOR gate 361 inverts the internal clock signal OSC and outputs the inverted clock signal. Therefore, the clock signal OSCO has the same period as the period of the internal clock signal OSC.

However, when the signal CA is a high-level signal, that is, when a detection voltage applied to the comparator 340 among the detection voltages V1 to V32 is lower than the reference voltage Vref, the NOR gate 361 outputs a low-level clock signal OSCO regardless of the internal clock signal OSC. Then, at the moment that one of the detection voltages V1 to V32 is lower than the reference voltage Vref, a period of the clock signal OSCO is increased. A detailed description for operation will now be provided with reference to FIG. 2.

The shift register 390 sequentially outputs detection control signals Q1 to Q32 with a time unit that is changed according to the clock signal OSCO. The shift register 390 includes an N-bit counter 391 and D flip-flops 301 to 332. The N-bit counter 391 and D flip-flops 301 to 332 operate according to the clock signal OSCO. In further detail, a period of the clock signal OSCO input to the N-bit counter 391 is counted and when a time period that corresponds to a predetermined period is passed, and a pulse signal that corresponds to one period of the clock signal OSCO is generated and transmitted to the D flip-flop 301. Here, the predetermined period corresponds to the number of the plurality of LED rows S1 to S32. In further detail, the N-bit counter 391 counts the periods of the clock signal OSCO by a unit of 32 periods, and outputs a pulse signal that is synchronized at the moment that the next period starts after 32 periods are finished and maintained in a high level during a period that corresponds to a normal period of the clock signal OSCO. Here, the normal period is a period of the clock signal OSCO when the detection voltages V1 to V32 are higher than the reference voltage Vref, and corresponds to a period of the internal clock signal OSC. The D flip-flops 301 to 332 outputs signals that are input to an input end D for one period of the present clock signal OSCO for one period of the next clock signal OSCO. Each D flip-flop according to the exemplary embodiment of the present invention determines falling edge timing of the clock signal OSCO input to a clock end CLK as one new period of the clock signal OSCO. The D flip-flop is synchronized at a falling edge timing of the next clock signal OSCO input to the clock end CLK, and outputs signals that are input to the input end for one period of the present clock signal OSCK for one period of the next clock signal OSCO. The N-bit counter 391 counts the falling edge timing of the clock signal OSCO to count a period of the clock signal OSCO. The number of the D flip-flops 301 to 332 is determined by the number of the plurality of LED rows S1 to S32, and the detection control signals Q1 to Q32 that are output signals of the D flip-flops 301 to 332 control on-off of the switches SW1 to SW32 that correspond to the detection control signals Q1 to Q32. A detailed description for operation of the shifter register 390 will be provided later with reference to FIG. 2.

The feedback signal generator 350 generates feedback information for an output voltage Vout by using a clock control signal COUT. In the exemplary embodiment of the present invention, the feedback signal generator 350 is described as an element that is separated from the PWM controller 200, but the present invention is not limited thereto. Therefore, the PWM controller 200 may include the feedback signal generator 350. The feedback signal generator 350 includes switches P1, N1, and N2, a capacitor, a discharging current source IN, and a charging current source IP. The clock control signal COUT is input to gate electrodes of the switches P1 and N1, and the charging current source IP is connected to a source electrode of the switch P1. A voltage VCC is a voltage for driving the charging current source IP. The discharging current source switch N1 is connected to the source electrode of the switch N1. A first end of the capacitor C1 and the gate electrode of the switch N2 are connected to a node to which drain electrodes of the switches P1 and N1 are connected. A second end of the capacitor C1 and a source electrode of the switch N2 are grounded, and a drain electrode of the switch N2 is connected to a node to which a resistor R1 and a resistor R2 are connected. First, when a detection voltage that is lower than the reference voltage Vref is generated among the detection voltages V1 to V32, the switch N1 is turned on by a high-level clock control signal and a voltage of the capacitor C1 is reduced by a current of the discharging current source IN. Then, the switch N2 is turned off so that a voltage of a feedback signal VF is increased. When the feedback signal VF is increased, the PWM controller 200 increases the duty of the switch M to control an inductor current IL to flow to the capacitor C through the diode D. Then, the output voltage Vout is increased so that the detection voltage that is lower than the reference voltage Vref is increased. On the contrary, when a detection voltage that is higher than the reference voltage Vref is generated among the detection voltages V1 to V32, the switch P1 is turned on by a low-level clock control signal COUT and the voltage of the capacitor C1 is increased by a current of the charging current source IP. Then, the switch N2 is turned on so that the voltage of the feedback signal VF is reduced. When the feedback signal VF is reduced, the PWM controller 200 increases the duty of the switch M to control the inductor current IL to flow to the switch M. Then, the output voltage Vout is reduced so that the detection voltage that is higher than the reference voltage Vref is reduced.

A driving method of the control device according to the exemplary embodiment of the present invention will now be described with reference to FIG. 2.

Figure 2:
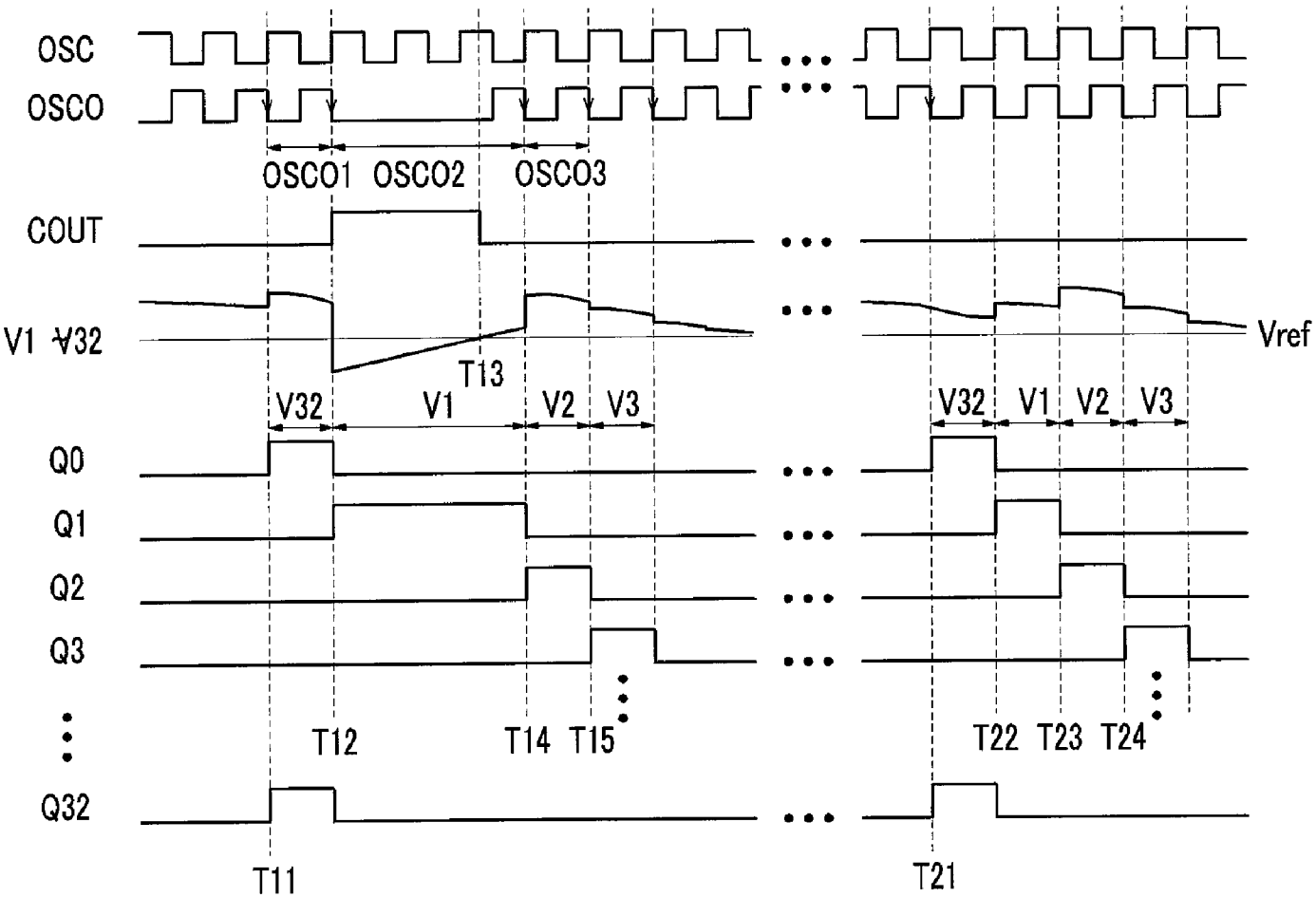
FIG. 2 shows an internal clock signal, a clock signal, a clock control signal, a detection voltage, a reference voltage, and a detection control signal.

FIG. 2 shows the internal clock signal, the clock signal, the clock control signal, the detection voltage, the reference voltage, and the detection control signal according to the exemplary embodiment of the present invention.

First, for a time T11 to T12, the detection control signal Q32 for detecting the detection voltage V32 for one period of a clock signal OSCO1 becomes a high level signal. Then, the detection voltage V32 is transmitted to an inversion terminal of the comparator 340.

At the time T11, the N-bit counter 391 finishes counting of 32 periods of the clock signal OSCO before the time T11, and newly starts counting. The N-bit counter 391 is synchronized at the time T11 and outputs a start signal Q0 that is maintained at a high level during the normal clock period. When the start signal Q0 is transmitted to an input end D of the D flip-flop 301 and the clock signal OSCO1 is transmitted to the clock end CLK, the D flip-flop 301 outputs the start signal Q1 input for a period T11 to T12, that is, one period of the clock signal OSCO1, as a detection control signal Q1 for one period of a clock signal OSCO2 input to a time T12. The D flip-flop 301 generates a high-level detection control signal Q1 from the time T12 and the switch SW1 is turned on by the high-level detection control signal Q1 so that a power voltage V1 is transmitted to the inversion terminal of the comparator 340. Since the power voltage V1 is lower than the reference voltage Vref, the comparator 340 generates a high-level clock control signal COUT and transmits the high-level clock control signal COUT to the AND gate 364. Then, the AND gate 364 transmits a high-level signal CA to the NOR gate 361, and the NOR gate 361 outputs a low-level clock signal OSCO2 regardless of the internal clock signal OSC. According to a period during which the clock signal OSCO2 is maintained at a low level, a period of the clock signal OSCO2 is determined. Resultantly, the period of the clock signal OSCO2 is increased. The switch N1 is turned on by a high-level clock control signal COUT, and the voltage of the capacitor C1 is decreased so that the switch N2 is turned off. Then, the feedback signal VF is increased, and the PWM controller 200 increases the duty of the switch M to increase the output voltage Vout. During a period T12 to T13, the detection voltage V1 is increased as the output voltage Vout is increased, and when the detection voltage V1 reaches the reference voltage Vref at the time T13, the comparator 340 generates a low-level clock control signal COUT. At the time T13, the internal clock signal OSC becomes high level and the signal CA becomes low level, and therefore the NOR gate 361 generates a clock signal OSCO by inversing the internal clock signal OSC after the time T13. That is, the D flip-flop 301 outputs the start signal Q0 input for one period of the clock signal OSCO1 to the next D flip-flop 302 for one period of the clock signal OSCO2. While measuring the detection voltage V10, the previously-stated present clock signal corresponds to a clock signal OSCO1 of FIG. 2 and the next clock signal corresponds to a clock signal OSCO2 of FIG. 2.

At a time T14, when a falling time of a clock signal OSCO3 is generated, the D flip-flop 302 outputs a detection control signal Q1 that is input for one period of the clock signal OSCO 2. Then, a detection control signal Q2 becomes high level and a detection voltage V2 is input to the inversion terminal (−) of the comparator 340. The comparator 340 outputs a low-level clock control signal since the detection voltage V2 is higher than the reference voltage Vref. Then, the signal CA becomes low level and therefore the NOR gate 361 inverts the internal clock signal OSC and outputs it as a clock signal OSCO. The switch P1 is turned on by the low-level clock control signal COUT, and the voltage of the capacitor C1 is increased so that the switch N2 is turned on. Then, the feedback signal VF is decreased, and the PWM controller 200 reduces the duty of the switch M to decrease the output voltage Vout. Then, the detection voltage V2 is also decreased. Through repetition of the above operations, the detection voltages V1 to V32 respectively corresponding to the 32 LED rows S1 to S32 of the synch current sources I1 to I32 are maintained close to the reference voltage Vref. Then the size of each of the currents of the synch current sources I1 to I32 is equalized so that all LEDs included in the 32 LED rows emit a constant amount of light.

At a time T21, new counting is started, and, as previously described, the N-bit counter 391 generates a start signal Q0 at the time T21 and transmits the start signal Q0 to the D flip-flop 301 and the D flip-flop 301 outputs signals input to a period T21 to T22 in a time T22.

In FIG. 2, a time that the start signal Q0 is generated and a time that the detection control voltage Q32 for detecting the detection voltage V32 is generated are illustrated to be the same. However, the present invention is not limited thereto, and the N-bit counter 391 may count a clock signal of 32 periods and then generate the start signal Q0 after a predetermined time delay.

As described, according to the exemplary embodiment of the present invention, the detection voltage of each of the plurality of LED rows is sequentially detected and controlled for normal operation of the synch current source, and the detection voltage is controlled to be close to the reference voltage.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A control device including a plurality of LED rows formed of a plurality of LEDs that are sequentially connected in series, comprising:

a plurality of switches respectively connected to the plurality of LED rows and sequentially transmitting a detection voltage of each of the plurality of LED rows, wherein the detection voltage corresponds to an output voltage applied to the plurality of LED rows;

a comparator receiving the plurality of detection voltages, and generating a clock control signal according to a result of comparison with a predetermined reference;

a clock signal generator generating a clock signal having a period that is changed according to the clock control signal; and a shift register that controls switching operations of the plurality of switches according to the clock signal.

2. The control device of claim 1, further comprising a plurality of synch current sources at an end of each of the plurality of LED rows, wherein each of the plurality of detection voltages are respectively supplied to the plurality of synch current sources, and the reference voltage is a minimum voltage for driving the synch current source.

3. The control device of claim 1, wherein the clock signal generator determines a period of the clock signal according to a time that a detection voltage that is lower than the reference voltage among the plurality of detection voltages reaches the reference voltage when the detection voltage is detected through the clock control signal.

4. The control device of claim 3, wherein the clock signal generator comprises:

an oscillator generating an internal clock signal having a predetermined period; and a first logical operator that receives the internal clock signal and a signal corresponding to the clock control signal, wherein the first logical operator generates a clock signal when the clock control signal is at a first level, and generates a third level clock signal when the clock control signal is at a second level.

5. The control device of claim 4, wherein the clock signal generator further comprises a second logical operator that receives the clock control signal and a reset signal that becomes a pulse signal for a predetermined time period when the control device is driven and is maintained at a constant level during a normal state, and the second logical operator determines a level of an output signal according to the clock control signal and transmits the output signal of the determined level to the first logical operator for the normal state.

6. The control signal of claim 5, wherein the comparator receives the detection voltage through an inversion terminal and the reference voltage through a non-inversion terminal, and the first logical operator is a NOR gate, the second logical operator is an AND gate, the first level is a high level, and the second and third levels are low levels.

7. The control device of claim 1, wherein the shift register comprises a counter that generates a start signal by counting the clock signal a number of times that corresponds to the number of the plurality of LED rows, and sequentially outputs the start signal to a plurality of switches for each period of the clock signal from a time that is delayed for one period of the clock signal from a first time that the start signal is generated.

8. The control device of claim 7, wherein the shift register comprises a plurality of flip-flops that respectively correspond to the number of the plurality of LED rows, and the n-th flip-flop among the plurality of flip-flops outputs an output signal of the (n−1)th flip-flop that is input for the n-th period of the clock signal with reference to the first time to the (n+1)th flip-flop for the (n+1)th period of the clock signal.

9. The control device of claim 8, wherein switching operations of each of the plurality of switches are controlled by an output signal output from each of the plurality of flip-flops.

10. The control device of claim 1, further comprising a feedback signal generator that generates a feedback signal that corresponds to the output voltage according to the clock control signal.

11. The control device of claim 10, wherein the feedback signal generator comprises:

a capacitor;

charging and discharging switches that perform switching operations according to the clock control signal;

a charging current source that supplies a charging current to the capacitor when the charging switch is turned on;

a discharging current source that discharges the capacitor when the discharging switch is turned on; and a feedback switch that performs switching operations according to voltages at lateral ends of the capacitor, wherein the charging and discharging switches are alternately turned on/off.

12. An LED light emitting device that includes a plurality of LED rows formed of a plurality of LEDs that are sequentially connected in series, comprising:

a converter including a power switch and an inductor, and generating an output voltage applied to the plurality of LED rows by controlling a current flowing to the inductor according to switching operations of the power switch;

a PWM controller that controls the switching operation of the power switch; and a control device that generates a clock signal that corresponds to the output voltage applied to the plurality of LED rows and having a varying period according to a result of comparison between a detection voltage of each of the plurality of LED rows and a predetermined reference voltage, sequentially measures the plurality of detection voltages according to the clock signal, and generates a feedback signal corresponding to the output voltage according to the comparison result and transmitting the feedback signal to the PWM controller.

13. The LED light emitting device of claim 12, wherein the control device comprises:

a plurality of switches respectively connected to the plurality of LED rows, and sequentially transmitting a plurality of detection voltages that correspond to output voltages applied to the plurality of LED rows;

a comparator receiving the plurality of detection voltages, and generating a clock control signal according to a result of comparison between the detection voltage and the reference voltage;

a clock signal generator that generates a clock signal having a varying period according to the clock control signal; and a shift register that controls switching operations of the plurality of switches according to the clock signal.

14. The LED light emitting device of claim 12, wherein the control device further comprises a plurality of synch current sources respectively provided at each end of the plurality of LED rows, each of the plurality of detection voltages is a voltage supplied to the plurality of synch current sources, and the reference voltage is a minimum voltage for driving the synch current source.

15. The LED light emitting device of claim 13, wherein, when a detection voltage that is lower than the reference voltage among the plurality of detection voltages is detected through the clock control signal, the clock signal generator determines a period of the clock signal according to a time that the low detection voltage reaches the reference voltage.

16. The LED light emitting device of claim 15, wherein the clock signal generator comprises:

an oscillator that generates an internal clock signal having a predetermined period; and a first logical operator that receives the internal clock signal and a signal that corresponds to the clock control signal, wherein the first logical operator generates a clock signal according to the internal clock signal when the clock control signal is a first level, and generates a third-level clock signal when the clock control signal is a second level.

17. The LED light emitting device of claim 16, wherein the clock signal generator further comprises a second logical operator that receives the clock control signal and a reset signal that becomes a pulse signal for a predetermined period when the control device is driven and is maintained at a constant level at a normal state, and during the normal state, the second logical operator determines a level of an output signal according to the clock control signal and transmits the output signal to the first logical operator.

18. The LED light emitting device of claim 13, wherein the shift register comprises a counter that generates a start signal by counting the clock signal a number of times that corresponds to the plurality of LED rows, and sequentially outputs the start signal to each of a plurality of switches for each period of the clock signal from a time that is delayed for one period of the clock signal from a first time that the start signal is generated.

19. The LED light emitting device of claim 12, wherein the control device further comprises:

a capacitor, charging and discharging switches that perform switching operations according to the clock control signal;

a charging current source that supplies a charging current to the capacitor when the charging switch is turned on;

a discharging current source that discharges the capacitor when the discharging switch is turned on; and a feedback switch that performs switching operations according to voltages at lateral ends of the capacitor, wherein the charging and discharging switches are alternately turned on/off.

20. The LED light emitting device of claim 19, wherein the PWM controller controls the duty of the power switch according to the feedback signal.

* * * * *